US005370803A

United States Patent [19]

Esche, Jr. et al.

[11] Patent Number: 5,370,803

[45] Date of Patent: Dec. 6, 1994

[54] EFFICIENT METHOD OF PRODUCING LUBRICANT DETERGENT ADDITIVES

[75] Inventors: Carl K. Esche, Jr., Wappinger Falls, N.Y.; James W. Moore, Sugar Land, Tex.

[73] Assignee: Texaco Inc., White Plains, N.Y.

[21] Appl. No.: 115,840

[22] Filed: Sep. 3, 1993

[51] Int. Cl.[5] ..... C10M 1/40

[52] U.S. Cl. ..... 252/18; 252/33; 252/42.7

[58] Field of Search ..... 252/18, 42.7, 33

[56] References Cited

U.S. PATENT DOCUMENTS 4,057,504 11/1977 Shiga et al. ..... 252/33
4,293,431 10/1981 Demoures et al. ..... 252/33.2
4,865,754 9/1989 Chang ..... 252/39

*Primary Examiner*—Prince Willis, Jr.
*Assistant Examiner*—Cephia D. Toomer
*Attorney, Agent, or Firm*—George J. Darsa

[57] ABSTRACT

A method of preparing a lubricant detergent additive at a significantly enhanced filtration rate comprising the steps of:

(a) mixing a neutral calcium sulfonate with sulfur, diluent oil, ($C_5$–$C_{40}$) alkylphenol, ethylene glycol, and calcium hydroxide to form a mixture;

(b) agitating said mixture at a temperature of about 150° C. to about 200° C. for a period of about four hours;

(c) bubbling $CO_2$ into said agitated mixture to provide an intermediate product; and (d) filtering said intermediate product at a rate of about 50 ml per 3 to 6 minutes to provide the lubricant detergent additive.

4 Claims, No Drawings

EFFICIENT METHOD OF PRODUCING LUBRICANT DETERGENT ADDITIVES

BACKGROUND OF THE INVENTION

The present invention relates to lubricant additives and more particularly to an efficient means of producing a lubricant detergent additive.

Additives are added to motor oils to improve certain properties: e.g., wear, antioxidancy, dispersancy, detergency. However, the production of such additives is costly and sometimes time consuming.

Thus, an object of the present invention is to provide a method which is both time efficient and inexpensive for producing sulfurized calcium alkylphenate, a motor oil detergent additive.

DISCLOSURE STATEMENT

U.S. Pat. No. 4,865,754 discloses the preparation of low overbased sulfurized calcium phenates in the presence of a calcium sulfonate. This phenate has improved storage stability at high temperatures and improved water tolerance.

U.S. Pat. No. 4,614,602 discloses a process for preparing low based phenate sulfonate mixtures by co-overbasing phenates in the presence of one or more sulfonates with a mole ratio of phenate to sulfonate ranging from 0.2:1.0 to 4:1.

U.S. Pat. No. 4,412,927 discloses the preparation of detergent compositions of high alkalinity by overbasing a sulfurized calcium phenate or a low TBN sulfurized calcium phenate in the presence of alkaline earth metal sulfonate of TBN less than or equal to 150.

U.S. Pat. No. 4,302,342 discloses the preparation of 200 plus TBN detergent composition and containing 2% magnesium by sulfurizing alkylphenol in the presence of magnesium or calcium alkylbenzene sulfonate of TBN less than or equal to 150 and then overbasing with carbon dioxide and magnesium oxide or lime.

U.S. Pat. No. 4,293,431 discloses an invention of reacting alkylphenol and sulfur in the presence of an alkylbenzene sulfonate of TBN less than or equal to 150, and other base containing compounds, and then carbonating this mixture.

U.S. Pat. No. 4,049,560 discloses an invention where 200+ TBN magnesium sulfurized nonylphenates are prepared by carbonating a sulfur containing alkylphenol in the presence of a sulfonic acid, sulfonate, or sulphate, an alkanol, magnesium oxide or hydroxide, and a promoter that is a carboxylic acid, anhydride, or amine salt. The filtration rate for some of the phenates prepared as described above were listed.

U.S. Pat. No. 3,493,516 discloses an invention where aliphatic carboxylic acids where added to a reaction mixture that contained alkylphenol, sulfur, base, tridecylalcohol and basic calcium sulfonate to obtain a 10% increase in TBN. The carboxylic acid was used as an overbasing promoter.

SUMMARY OF THE INVENTION

A method of preparing a lubricant detergent additive at a significantly enhanced filtration rate comprising the steps of:

(a) mixing a neutral calcium sulfonate with sulfur, diluent oil, a ($C_5$–$C_{40}$) alkylphenol, ethylene glycol, and calcium hydroxide to form a mixture;

(b) agitating said mixture at a temperature of about 150° C. to about 200° C. for a period of about four hours;

(c) bubbling $CO_2$ into said agitated mixture to provide an intermediate product; and (d) filtering said intermediate product at a rate of about 50 ml per 3 to 6 minutes to provide the lubricant detergent additive.

DETAILED DESCRIPTION OF THE INVENTION

This invention in providing a more efficient, inexpensive method of producing a lubricant detergent additive, i.e., a sulfurized calcium alkylphenate, places an emphasis on enhancing the filtration rate of the phenate detergent additive.

In improving the filtration rate of the phenate product, a filtration aid is provided from a group of sulfonates which include those described below.

Description of Sulfonates

Calcium Sulfonate A

A 50/50 blend of a synthetic and natural sulfonate. The synthetic sulfonate is a didodecylbenzene sulfonate. The natural portion is composed of two difference sources of natural sulfonate in a 25/75 mix.

Calcium Sulfonate B

A 50/50 blend of a synthetic and natural sulfonate. The synthetic portion is a didodecylbenzene sulfonate. The natural portion is 100% from a single source.

Calcium Sulfonate C

A natural sulfonate with an average molecular weight of 1090 gms/mol.

Calcium Sulfonate D

A 100% synthetic didodecylbenzene sulfonate.

In developing the present method, the teachings of the prior art (i.e., the industry of lubricant additives) have been considered.

The prior art teaches the use of neutral sulfonates and overbased sulfonates as overbasing promoters for producing overbased sulfurized phenates.

However, the prior art does not mention the use of neutralized calcium sulfonate as a filtration aid for neutralized sulfurized calcium alkylphenate. By increasing the phenate's rate of filtration, a lower cost phenate is achieved.

Secondly, not all neutral calcium sulfonates improve the phenates rate of filtration. Only sulfonates that contain a mixture of petroleum or natural sulfonate and synthetic sulfonate produced the best rate of filtration.

Thirdly, the rate of filtration is directly proportional to the amount of sulfonate. The 90 TBN calcium sulfurized phenate filters faster as the amount of sulfonate is increased.

If the 90 TBN sulfurized calcium phenate is not fortified with a processing aid, then the phenate filters much slower. This results in a higher cost phenate because of reduced plant output. If solvent is used to increase the phenate's rate of filtration, then time and money must be spent stripping the solvent from the product, purifying the solvent for reuse or disposing of the solvent.

By the teachings of the present invention, it is also anticipated that overbased phenates could also be made to filter faster if select sulfonates were added to the phenate.

In order to show the advantages of the present invention, the following Examples are provided.

EXAMPLE 1

Neutralized Calcium Sulfurized Dodecylphenate: (Control-No Sulfonate)

Into a round bottom flask equipped with a reflux condenser, thermocouple, thermometer, Dean Stark Trap, and gas inlet tube were added all of the following ingredients: sulfur (21.20, 0.66 mol), dodecylphenol (150.0 gms, 0.585 mol), 100 P Pale Oil (171.1 gms), ethylene glycol (15.0 gms, 0.240 mol), and calcium hydroxide (22.90 gms, 0.310 mols). With vigorous agitation and nitrogen gas (200 ml/min) being bubbled into the reaction mixture, the reactor was heated to 170° C. and stirred for four hours. Subsequently, carbon dioxide (100 ml/min) was bubbled into the reaction mixture for 3 minutes. The product was filtered hot through celite and solvent stripped on a rotovap under vacuum to yield 195 gms of product with the following analysis: % Ca=3.19, % S=3.26, TBN=88.86, and kinetic viscosity at 100° C.=38.5.

EXAMPLE 2

Neutralized Calcium Sulfurized Dodecylphenate With 3 Wt. % Diluent Oil

Into a round bottom flask equipped with a reflux condenser, thermocouple, thermometer, Dean Stark Trap, and gas inlet tube were added all of the following ingredients: sulfur (21.20, 0.66 mol), dodecylphenol (150.0 gms, 0.585 mol), 100 P Pale Oil (181.6 gms), ethylene glycol (15.0 gms, 0.240 mol), and calcium hydroxide (22.90 gms, 0.310 mols). With vigorous agitation and nitrogen gas (200 ml/min) being bubbled into the reaction mixture, the reactor was heated to 170° C. and stirred for four hours. Subsequently, carbon dioxide (100 ml/min) was bubbled into the reaction mixture for 3 minutes. The product was filtered hot through celite and solvent stripped on a rotovap under vacuum to yield 174 gms of product with the following analysis: % Ca=2.65, % S=3.39, TBN=73, and kinetic viscosity at 100° C.=26.3.

EXAMPLE 3

Sulfurized Calcium Dodecylphenate with 3 WT % Of Neutral Calcium Sulfonate A Into a round bottom flask equipped with a reflux condenser, thermocouple, thermometer, Dean Stark Trap, and gas inlet tube were added all of the following ingredients: sulfur (21.20, 0.66 mol), dodecylphenol (150.0 gms, 0.585 mol), 100 P Pale Oil (171.1 gms), ethylene glycol (15.0 gms, 0.240 mol), neutral calcium sulfonate A (10.5 gms, 0.00478 moles) and calcium hydroxide (22.90 gms, 0.310 mols). With vigorous agitation and nitrogen gas (200 ml/min) being bubbled into the reaction mixture, the reactor was heated to 170° C. and stirred for four hours. Subsequently, carbon dioxide (100 ml/min) was bubbled into the reaction mixture for 3 minutes. The product was filtered hot through celite and solvent stripped on a rotovap under vacuum to yield 185 gms of product with the following analysis: % Ca=3.12, % S=3.57, TBN=85, and kinetic viscosity at 100° C.=41.5.

EXAMPLE 4

Sulfurized Calcium Dodecylphenate with 2 Wt. % Of Natural Calcium Sulfonate A Into a round bottom flask equipped with a reflux condenser, thermocouple, thermometer, Dean Stark Trap, and gas inlet tube were added all of the following ingredients: sulfur (21.20, 0.66 mol), dodecylphenol (150.0 gms, 0.585 mol), 100 P Pale Oil (171.1 gms), ethylene glycol (15.0 gms, 0.240 mol), neutral calcium sulfonate A (7.0 gms, 0.0032 moles) and calcium hydroxide (22.90 gms, 0.310 mols). With vigorous agitation and nitrogen gas (200 ml/min) being bubbled into the reaction mixture, the reactor was heated to 170° C. and stirred for four hours. Subsequently, carbon dioxide (100 ml/min) was bubbled into the reaction mixture for 3 minutes. The product was filtered hot through celite and solvent stripped on a rotovap under vacuum to yield 234 gms of product with the following analysis: % Ca=2.81, % S=2.94, TBN=78, and kinetic viscosity at 100° C.=19.4.

EXAMPLE 5

Sulfurized Calcium Dodecylphenate with 1 Wt. % Of Neutral Calcium Sulfonate A Into a round bottom flask equipped with a reflux condenser, thermocouple, thermometer, Dean Stark Trap, and gas inlet tube were added all of the following ingredients: sulfur (21.20, 0.66 mol), dodecylphenol (150.0 gms, 0.585 mol), 100 P Pale Oil (171.1 gms), ethylene glycol (15.0 gms, 0.240 mol), neutral calcium sulfonate A (3.5 gms, 0.0016 moles) and calcium hydroxide (22.90 gms, 0.310 mols). With vigorous agitation and nitrogen gas (200 ml/min) being bubbled into the reaction mixture, the reactor was heated to 170° C. and stirred for four hours. Subsequently, carbon dioxide (100 ml/min) was bubbled into the reaction mixture for 3 minutes. The product was filtered hot through celite and solvent stripped on a rotovap under vacuum to yield 177 gms of product with the following analysis: % Ca=2.99, % S=3.36, TBN=82.4, and kinetic viscosity at 100° C.=37.6.

EXAMPLE 6

Sulfurized Calcium Dodecylphenate with 3 Wt. % of Neutral Calcium Sulfonate B Into a round bottom flask equipped with a reflux condenser, thermocouple, thermometer, Dean Stark Trap, and gas inlet tube were added all of the following ingredients: sulfur (21.20, 0.66 mol), dodecylphenol (150.0 gms, 0.585 mol), 100 P Pale Oil (171.1 gms), ethylene glycol (15.0 gms, 0.240 mol), neutral calcium sulfonate B (10.5 gms, 0.00477 moles) and calcium hydroxide (22.90 gms, 0.310 mols). With vigorous agitation and nitrogen gas (200 ml/min) being bubbled into the reaction mixture, the reactor was heated to 170° C. and stirred for four hours. Subsequently, carbon dioxide (100 ml/min) was bubbled into the reaction mixture for 3 minutes. The product was filtered hot through celite and solvent stripped on a rotovap under vacuum to yield 219 gms of product with the following analysis: % Ca=3.03, % S=2.94, TBN=82, and kinetic viscosity at 100° C.=48.9.

EXAMPLE 7

Sulfurized calcium Dodecylphenate with 3 Wt. % of Neutral Calcium Sulfonate C Into a round bottom flask equipped with a reflux condenser, thermocouple, thermometer, Dean Stark Trap, and gas inlet tube were added all of the following ingredients: sulfur (21.20, 0.66 mol), dodecylphenol (150.0 gms, 0.585 mol), 100 P Pale Oil (171.1 gms), ethylene glycol (15.0 gms, 0.240 mol), neutral calcium sulfonate C (10.5 gms, 0.00460 moles) and calcium hydroxide (22.90 gms, 0.310 mols). With vigorous agitation and nitrogen gas (200 ml/min) being bubbled into the reaction mixture, the reactor was heated to 170° C. and stirred for four hours. Subsequently, carbon dioxide (100 ml/min) was bubbled into the reaction mixture for 3 minutes. The product was filtered hot through celite and solvent stripped on a rotovap under vacuum to yield 145 gms of product with the following analysis: % Ca=3.13, % S=3.24, TBN=88.5, and kinetic viscosity at 100° C.=39.7.

EXAMPLE 8

Sulfurized Calcium Dodecylphenate with 3 wt. % of Neutral Calcium Sulfonate D Into a round bottom flask equipped with a reflux condenser, thermocouple, thermometer, Dean Stark Trap, and gas inlet tube were added all of the following ingredients: sulfur (21.20, 0.66 mol), dodecylphenol (150.0 gms, 0.585 mol), 100 P Pale Oil (171.1 gms), ethylene glycol (15.0 gms, 0.240 mol), neutral calcium sulfonate D (10.5 gms, 0.00536 moles) and calcium hydroxide (22.90 gms, 0.310 mols). With vigorous agitation and nitrogen gas (200 ml/min) being bubbled into the reaction mixture, the reactor was heated to 170° C. and stirred for four hours. Subsequently, carbon dioxide (100 ml/min) was bubbled into the reaction mixture for 3 minutes. The product was filtered hot through celite and solvent stripped on a rotovap under vacuum to yield 204 gms of product with the following analysis: % Ca=3.22, % S=3.21, TBN=85, and kinetic viscosity at 100° C.=40.

In order to show the effectiveness of the different sulfonates (i.e., A, B, etc.) comparative filtration tests were conducted on the products of the above Examples. The filtration procedure used in the comparison testing is provided below.

FILTRATION PROCEDURE

A small Buchner funnel and Erlenmeyer filtering flask are connected to the plant vacuum lines. A 5.5 cm Whatman #4 filter paper is placed inside the Buchner funnel. Next, 4.5 gms of preweighed filter aid is added to the Buchner funnel and smoothed out. The filter aid is not to be compressed by any object. Next 50 mls of crude product, at reaction temperature and vigorously stirred to suspend solids, is rapidly poured into the Buchner funnel and the time it takes to filter the phenate is measured. This procedure was developed to distinguish between large differences in the rate of filtration. The filtration times are provided below in Table I.

TABLE I

FILTRATION TEST DATA

| Example # | Description | Timed Filtration (50 ml) Min | Sec |
|---|---|---|---|
| 1 | Control: No Sulfonate | 10 | 0 |

TABLE I-continued

FILTRATION TEST DATA

| Example # | Description | Timed Filtration (50 ml) Min | Sec |
|---|---|---|---|
| 2 | Control + 3 wt % diluent oil | 10 | 30 |
| 3 | 3 wt % Sulfonate A | 3 | 5 |
| 3(repeated) | 3 wt % Sulfonate A | 3 | 20 |
| 4 | 2 wt % Sulfonate A | 4 | 50 |
| 5 | 1 wt % Sulfonate A | 9 | 30 |
| 6 | 3 wt % Sulfonate B | 5 | 15 |
| 7 | 3 wt % Sulfonate C | 11 | 45 |
| 8 | 3 wt % Sulfonate D | 14 | 55 |

Data Analysis

Experiment one indicates that a 90 TBN sulfurized calcium phenate has a filtration rate of ten minutes using this filtration technique. Diluting the phenate with 3 wt % diluent oil does not increase the rate of filtration, However, adding 3 wt % of sulfonate A to the phenate during its synthesis increases its rate of filtration approximately threefold with a filtration time of only 3 minutes 5 seconds. As the amount of sulfonate was reduced to 2 and 1 wt %, the rate of filtration for the phenate decreased to 4 minutes 50 seconds and 9 minutes 30 seconds, respectively. This illustrates the concentration dependency the sulfonate has on the phenate's rate of filtration. Sulfonate B, very similar to sulfonate A, doubled the rate of filtration by cutting the filtration time in half to 5 minutes 15 seconds. 3 wt % of sulfonate C does not improve the rate of filtration and is slightly worse than the control. Sulfonate D performed the poorest with an almost 50% decrease in the rate of filtration.

As illustrated above in Table I, the acceptable rate of filtration of the phenate product additive is a rate of about 50 ml per 3 to 6 minutes.

In summary, the two sulfonates that filtered the best were sulfonates A and B, i.e., the ones containing a mixture of natural and synthetic sulfonate. Natural or synthetic sulfonates by themselves did not perform as well.

We claim:

1. A method of preparing a sulfurized calcium alkylphenate, a lubricant detergent additive, at a significantly enhanced filtration rate comprising the steps of:
   (a) mixing a neutral calcium sulfonate containing a 50/50 blend of petroleum or natural sulfonate and synthetic sulfonate as a filtration aid with sulfur, diluent oil, ($C_5$–$C_{40}$) alkylphenol, ethylene glycol and calcium hydroxide to form a mixture;
   (b) agitating said mixture at a temperature of about 150° C. to about 200° C. for a period of about four hours;
   (c) bubbling $CO_2$ into said agitated mixture to provide an intermediate product; and
   (d) filtering said intermediate product at a rate of about 50 milliliters per 3 to 6 minutes to provide the lubricant detergent additive.

2. The method according to claim 1, wherein said alkyl phenol is dodecylphenol.

3. The method of claim 1 wherein said product is sulfurized calcium dodecylphenate.

4. The method of claim 1, wherein said mixture is agitated for four hours at a temperature of about 170° C.

* * * * *